US011131165B2

(12) United States Patent
MacDonald

(10) Patent No.: US 11,131,165 B2
(45) Date of Patent: Sep. 28, 2021

(54) ROLLING SEAL FOR TRANSFER OF PRESSURE IN A DOWNHOLE TOOL

(71) Applicant: Halliburton Energy Services, Inc., Houston, TX (US)

(72) Inventor: Lorn Scott MacDonald, Inverness (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/283,062

(22) Filed: Feb. 22, 2019

(65) Prior Publication Data

US 2019/0360303 A1 Nov. 28, 2019

(51) Int. Cl.

| | |
|---|---|
| ***E21B 34/10*** | (2006.01) |
| ***E21B 33/13*** | (2006.01) |
| ***E21B 33/00*** | (2006.01) |
| ***E21B 23/08*** | (2006.01) |
| ***E21B 23/04*** | (2006.01) |
| ***E21B 43/10*** | (2006.01) |

(52) U.S. Cl.

CPC ..... *E21B 34/10* (2013.01); *E21B 23/0412* (2020.05); *E21B 23/08* (2013.01); *E21B 33/00* (2013.01); *E21B 33/13* (2013.01); *E21B 43/10* (2013.01); *E21B 2200/04* (2020.05)

(58) Field of Classification Search

CPC ..... E21B 34/10; E21B 33/1208; E21B 23/04; E21B 23/0412; E21B 23/08; E21B 33/13; E21B 43/10; E21B 33/00; E21B 2200/04

USPC ..... 166/72, 88.3, 84.4, 108, 120, 212

See application file for complete search history.

(56) References Cited

U.S. PATENT DOCUMENTS

| | | | | |
|---|---|---|---|---|
| 4,624,465 | A | 11/1986 | Rogemont | |
| 6,302,216 | B1 | 10/2001 | Patel | |
| 9,475,686 | B2 * | 10/2016 | Tuohey | B67D 7/84 |
| 2003/0042048 | A1 | 3/2003 | Hughes et al. | |
| 2005/0087335 | A1 | 4/2005 | Vick, Jr. | |
| 2013/0192827 | A1 | 8/2013 | Garcia | |
| 2013/0213669 | A1 * | 8/2013 | Kriesels | E21B 33/068 166/380 |

FOREIGN PATENT DOCUMENTS

| | | |
|---|---|---|
| CN | 201706882 U | 1/2011 |

* cited by examiner

*Primary Examiner* — Taras P Bemko
*Assistant Examiner* — Manuel C Portocarrero
(74) *Attorney, Agent, or Firm* — Scott Richardson; Parker Justiss, P.C.

(57) ABSTRACT

This disclosure provides a completion tool that uses a rolling seal to actuate a flow valve or replace a piston in a down hole tool. The rolling seal is located in a fluid chamber of the completion tool and divides the fluid chamber into first and second smaller fluid chambers and fluidly seals the first smaller fluid chamber from the second smaller fluid chamber. The rolling seal responds to a fluid pressure within the fluid chamber that causes the closed end of the rolling seal to invert thereby transferring fluid pressure between the first and second fluid chambers, which actuates a flow valve actuation assembly.

20 Claims, 6 Drawing Sheets

ROLLING SEAL FOR TRANSFER OF PRESSURE IN A DOWNHOLE TOOL

CROSS-REFERENCE TO RELATED APPLICATION

This application claims priority to International Application No. PCT/US2018/034293 filed on May 24, 2018, and entitled "ROLLING SEAL FOR TRANSFER OF PRESSURE IN A DOWNHOLE TOOL". The above application is commonly assigned with this application and is incorporated herein by reference in its entirety.

BACKGROUND

It is well known in the subterranean well drilling and formation testing arts that many types of well tools are responsive to pressure, either in the annulus or in the tool string. For example, different types of tools for performing drill stem testing operations are responsive to either tubing or annulus pressure, or to a differential therebetween. Additionally, other down hole tools, such as safety valves, flow valves, or drill string drain valves, may be responsive to such a pressure differential. Such well tools typically have some member, such as a piston, that moves in response to the selected pressure stimuli. Additionally, these well tools typically have some mechanism to prevent movement of this member until a certain pressure threshold has been reached. For example, a piston may be either mechanically restrained by a mechanism, such as shear pins or ratchet devices, whereby the pressure must exceed the shear value of the restraining shear pins or ratchet for the member to move. Alternatively, a rupture disk, designed to preclude fluid flow until a certain threshold pressure differential is reached, may be placed in a passage between the movable member and the selected pressure source.

Once activated, the piston can be driven back and forth within a fluid chamber by fluid pressure for a predetermined number of reciprocations to exert pressure on an actuation device, after which a responsive down hole tool may be actuated in the way intended by its design.

BRIEF DESCRIPTION OF THE DRAWINGS

For a detailed description of the preferred embodiments of the invention, reference will now be made to the accompanying drawings in which.

DETAILED DESCRIPTION

As discussed above, pistons, such as floating pistons, are driven within a fluid chamber defined by an outer housing and an inner tube mandrel of a completion tool. The piston is operated by well bore fluid on one side of the fluid chamber and a hydraulic fluid, such as silicone oil on the other side of the fluid chamber to create a pressure force against an actuation device that can manipulate a down hole tool, such as a flow valve, to an open position or a closed position. The floating piston includes O-rings located about its outer perimeter that seal against the outer housing and the inner tube mandrel of the completion tool. While these seals typically perform within operating parameters, it has been found that as pressure is exerted on the outer housing, it can expand the outer housing to an extent that allows well bore fluids or water from the up hole chamber to enter the down hole, thereby contaminating the hydraulic fluid. These pistons can also become jammed or galled, thereby reducing, or losing completely, its ability to move within the fluid chamber.

The embodiments of the rolling seal, as discussed herein, address these problems. In certain embodiments, the rolling seal is comprised of a flexible material, such as a reinforced material. The flexible reinforce material may be a fabric or fiber comprised of an aramid, para-aramid or meta-aramid materials. Other types of materials include nylon, vectran, and glass fiber as well as all structural and textile fibers. Additionally, other known materials, such as reinforced rubber or plastics that are presently used in known down hole tool applications may also be used. The rolling seal is attached to the outer diameter of the outer housing and the inner tube mandrel to form a seal between that will have continuous contact with the outer housing and the inner tube mandrel regardless of the amount of expansion that occurs in the outer housing, thereby eliminating the fluid by-pass issues associated with conventional piston systems that occur with expansion of the outer housing.

The terms "up hole" and down hole" are used to describe the general positional relationship of devices comprising the completion tool when placed in a well bore, only, and it should be understood that these terms do not limit the embodiments of the completion tool to these directional orientations. As used herein and in the claims, "up hole" means the direction toward the surface of the well bore, while "down hole" means the direction toward the bottom, or production end of the well bore, regardless of the well bore's orientation. For example, these terms would also apply to a horizontal well bore as well as a vertical or slanted well bore.

Figure 1:
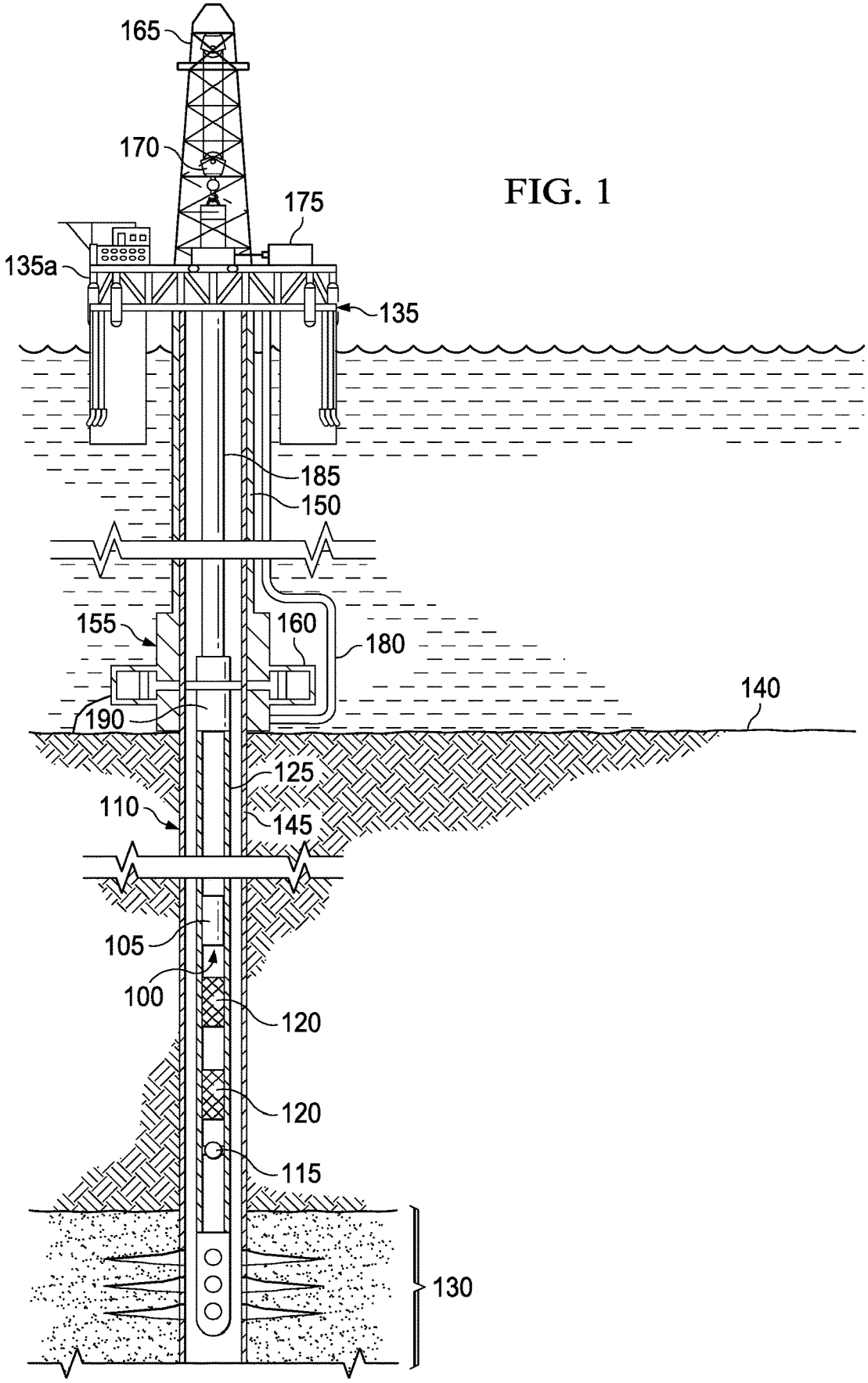
FIG. 1 is one embodiment of an environmental drilling rig in which the rolling seal may be implemented.

FIG. 1, illustrates one environment in which a completion tool 100, which includes embodiments of the rolling seal 105, may be implemented within a well bore 110. In the embodiment illustrated in FIG. 1, in addition to the rolling seal 105, the completion tool 100 comprises a known flow valve 115 and one or more known sand screens 120. The completion tool 100 will be connected to a completion string 125 that extends from the surface of the well bore 110 to at least a production zone 130 of the well bore 110. In FIG. 1, an example of one type of operating environment in which the completion tool 100 may be implemented is an offshore platform 135 positioned over a submerged oil or gas well bore 110 located in the sea floor 140, with well bore 110 penetrating the production zone 130. Wellbore 110 is shown to be lined with steel casing 145, which is cemented into place. A sub-sea conduit 150 extends from a deck 135*a* of platform 135 into a sub-sea wellhead 155, which includes blowout preventer 160. Platform 135 carries a derrick 165 thereon, as well as a hoisting apparatus 170, and a pump 175 that communicates with the well bore 110 by a way of a control conduit 180 and extends below blowout preventer 160. The completion tool 100 is shown disposed in well bore 110 with the blowout preventer 160 closed thereabout. Testing string 185 extends downward from platform 135 to wellhead 155, whereat is located hydraulically operated test tree 190.

The completion string 125 extends down hole to completion tool 100, which implements embodiments of the rolling seal 105 and actuation assembly, as discussed below. The completion tool 100 is a combination circulating and well closure valve. The structure of the flow valve opening and closing assemblies may be of the type known and utilized in the oil and gas industry.

Figure 2A:
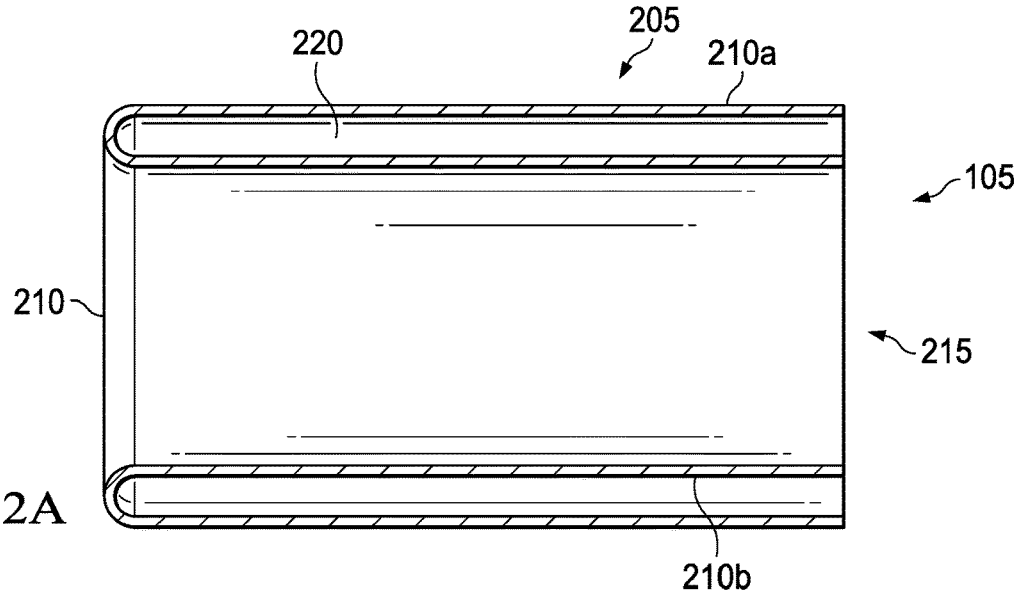
FIG. 2A is a sectional view of the rolling seal in a neutral position.
Figure 2B:
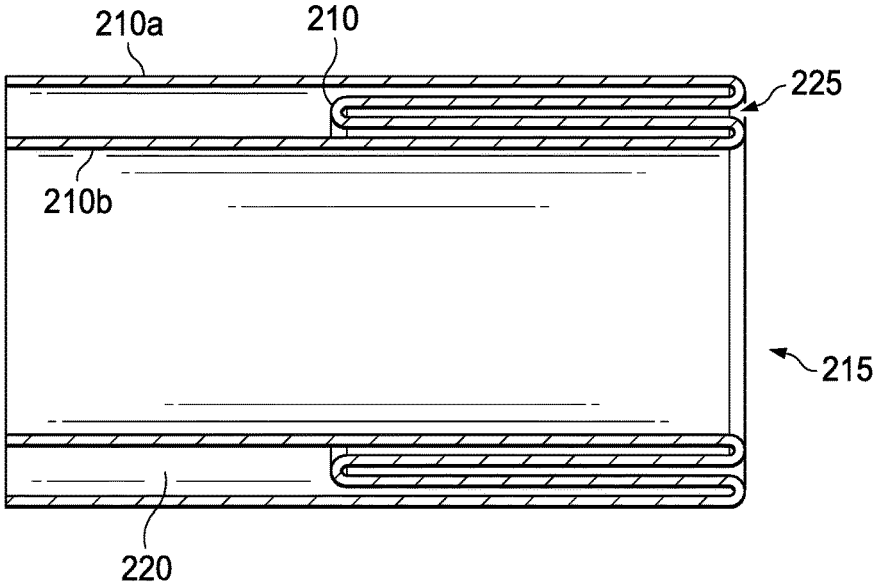
FIG. 2B is a sectional view of the rolling seal illustrating a partial inversion in response to a fluid pressure.
Figure 2C:
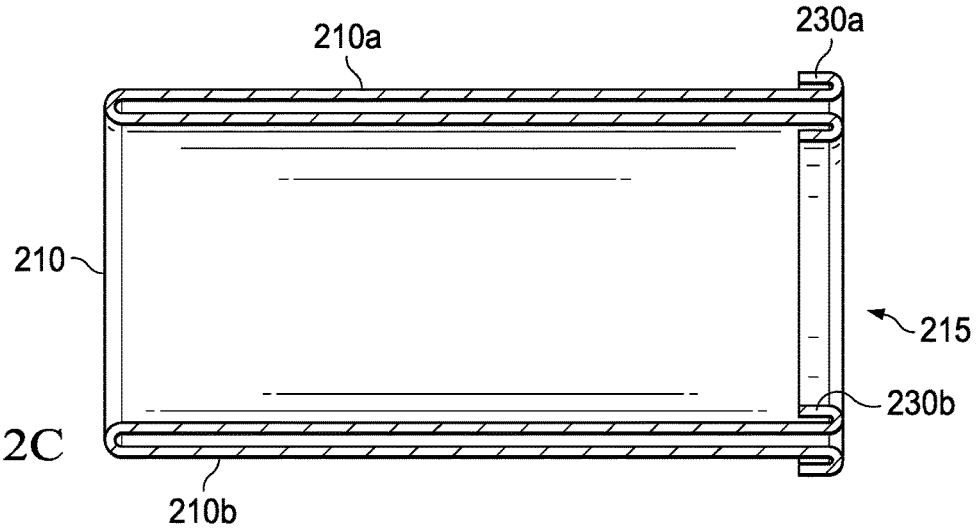
FIG. 2C is a sectional is view of the rolling seal in a substantially inverted configuration.

FIGS. 2A-2C illustrate an embodiment of the rolling seal 105, in various functional, positional configurations that will result from the application of fluid pressure. The rolling seal 105 is comprised of a flexible, resilient reinforced material, such as a those mentioned above that can withstand high pressure forces without tearing and that will form a fluid seal within the completion tool. The fabric reinforcement should also aid the ability of the rolling seal 105 to "roll," as the fabric would help maintain the shape of the rolling seal 105. Since there will be fluid on either side of the seal it will be supported during rolling and will have the ability to invert naturally, without collapsing. As used herein and in the claims "roll" or "rolling" means that the seal is able to invert (i.e., turn inside out and visa versa) in either direction, as pressure is applied to one side of the seal and then to the other. This "rolling" ability is demonstrated in the embodiments shown in FIGS. 2A-2C.

FIG. 2A illustrates the rolling seal 105 in a neutral position 205 within the completion tool 100, as assembled at or delivered to the drilling site. In the neutral position 205, the rolling seal 105 is positioned as it would be in the completion tool 100. The rolling seal 105 forms two sides 210*a* and 210*b*, that when folded as shown, form an open end 215 and a closed end 210, when properly attached to the completion tool 100, as discussed below. The rolling seal 105 also forms an interior volume 220 into which the closed end 210 extends in response to an applied fluid pressure.

FIG. 2B illustrates the rolling seal 105 where the closed end 210 has been inverted and forced into the interior volume 220 by fluid pressure 225. As used herein and in the claims "inverted" refers to a configuration where the rolling seal is only partially inverted or substantially inverted, as explained below. The extent to which the closed end 210 inverts into the interior volume 220 will depend on the amount or duration of fluid pressure applied to the rolling seal 105.

FIG. 2C illustrates the rolling seal 105 in a substantially inverted configuration. As used herein and in the claims, "substantially inverted" means that the entire length of the rolling seal 105 has been inverted, as shown, except for the end portions 230*a* and 230*b* that are unable to invert due to their attachment to the outer housing and the inner tube mandrel, as discussed below.

In one embodiment, the rolling seal 105 is generally cylindrically shaped or may have a general U-shaped cross section, as seen in FIG. 2A, when attached to the completion tool 100. However, it should be understood that other geometrical volumes are within the scope of this disclosure as well. The configuration of the rolling seal 105 allows the closed end to react to a fluid pressure being applied against it to drive it into the interior volume 220. When the pressure direction is reversed, the pressurized fluid exerts a force against the closed end 210 and forces it in the opposite direction, which increases the fluid pressure in the chamber in the direction of the inversion, thereby acting in the same manner as a piston, while avoiding the above-mentioned problems that can occur with known piston configurations.

Figure 3:
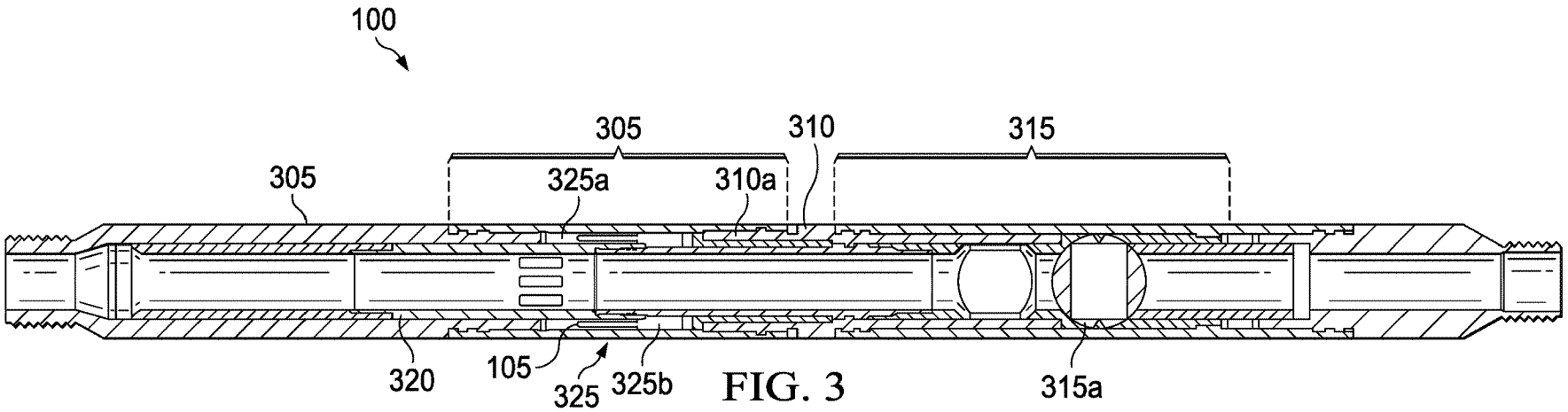
FIG. 3 is an embodiment of a completion tool in which the rolling seal may be implemented.

FIG. 3 illustrates an embodiment of the completion tool 100 in which the rolling seal 105 may be implemented. In this embodiment, the completion tool 100 is a completion tool that can be used to complete and initiate well production, and includes an outer housing 305. The up hole end of the outer housing 305 is coupled to a coupling mandrel that connects the completion tool 100 to a completion string 125 (not shown in this view). The down hole end of the outer housing 305 is coupled to a flow valve actuation assembly 310. The flow valve actuation assembly 310 may be any known type of actuation assembly, such as, including, but not limited to, a mechanical actuator, such as a latch assembly or indexing assembly 310*a*, a pressure activated electrical actuator, a pressure activated electromechanical actuator, a hydraulic actuator, or a pneumatic actuator. The flow valve actuation assembly 310 is operatively coupled to a flow valve 315 and is configured to move the flow valve to either one or both of an open or closed position.

In the illustrated embodiment, the flow valve 315 is a known ball valve system 315*a*. The ball valve system 315*a* may include a sliding sleeve that is operatively coupled to the ball valve such that movement of the sliding sleeve within the completion tool 100 correspondingly moves the ball valve from an open position to a closed position. In some embodiments, for example, a known mechanical coupling, mechanism, or linkage may operatively couple the sliding sleeve and the ball valve such that physical movement of the sliding sleeve will physically rotate the ball valve to a closed position after the completion tool 100 is positioned in the well bore.

The ball of ball valve 315*a* has a central port that when oriented along the longitudinal axis of the completion tool 100, allows production fluids to flow through completion tool and up hole to the surface of the well bore 110. When the central port is oriented approximately 90° (depending on ball valve design) to the longitudinal axis of the completion tool 100, the ball valve 315*a* prevents fluid flow through the completion tool 100. However, other flow valves, such as a flapper valve, a sliding sleeve or other known valve. Additionally, the rolling seal 105 may be used to replace a piston in any down hole tool.

Extending within the completion tool 100 is inner tube mandrel member 320 that, together with the outer housing 305 forms a fluid chamber 325 in which the rolling seal 105 is located. The rolling seal 105 seals and divides the fluid chamber 325 into two smaller fluid chambers 325*a* and 325*b*. The small fluid chamber 325*a* is fluidly connected to the inner tube mandrel member 320 such that drilling or well bore fluids may be pumped into the smaller fluid chamber 325*a*, and the smaller fluid chamber 325*b* contains a hydraulic fluid, such as silicone fluid. The smaller fluid chamber 325*b* is fluidly connected to the flow valve actuation assembly 310. The pressure is changed in the fluid chambers by volume change of the chambers. Up hole well fluids would be increased in pressure and this would push the rolling seal 105 down hole. As it moves down hole, it reduces the volume of the chamber 325*a* below it, compressing the fluid within this chamber. This would result in a build-up of pressure below the rolling seal 105 to equal that of the pressure above it. The rolling seal 105 accomplishes as it inverts and so reduces the chamber volume below it. An additional use of the rolling seal 105 could be for maintaining a clean debris free environment around critical components and is not limited to being a part of a cycling/indexing/actuation mechanism. This clean environment would need to be pressure balanced to accommodate hydrostatic well pressures, so this is where the Rolling Seal replaces a standard piston.

Figure 4:
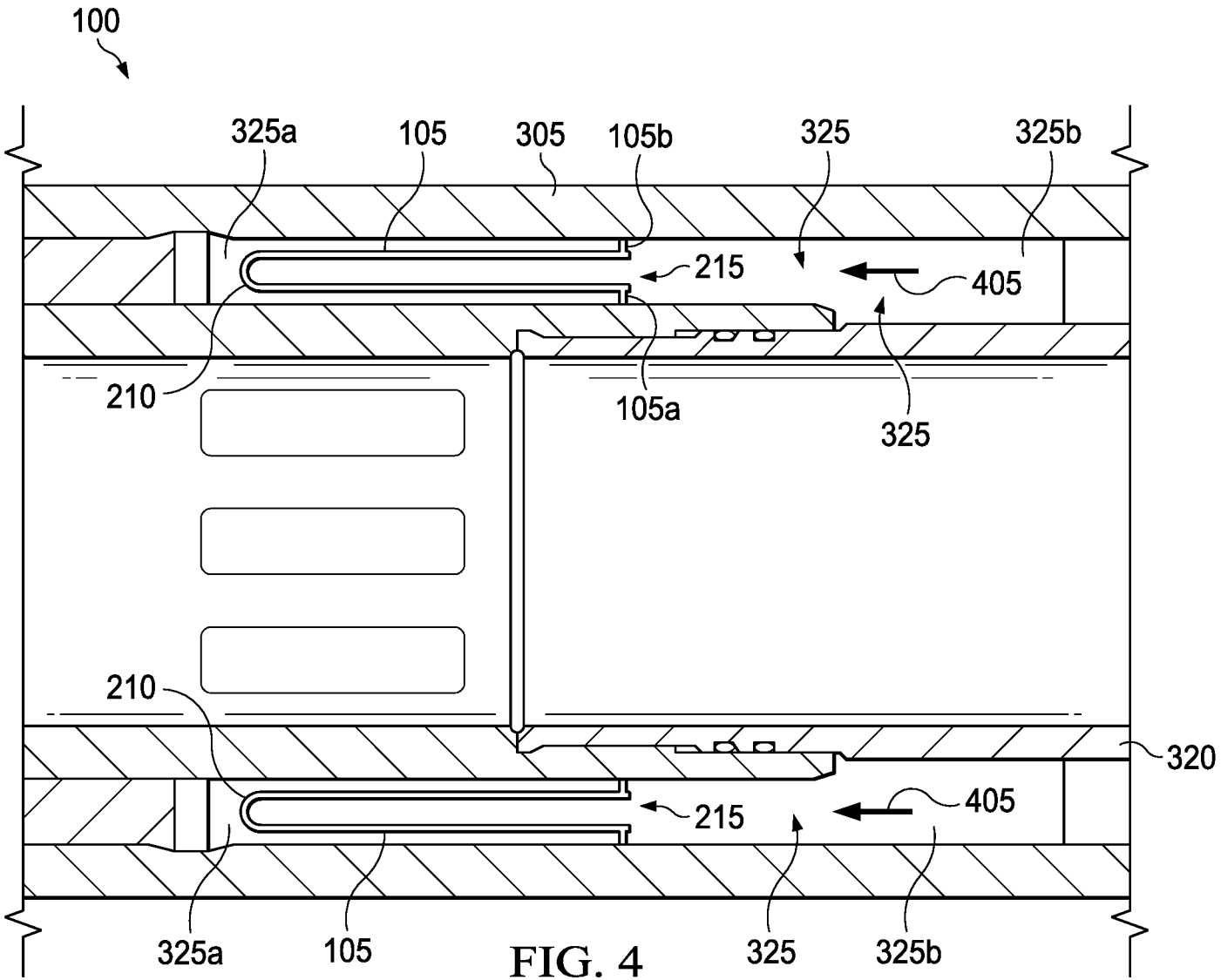
FIG. 4 is an enlarged view of the completion tool of FIG. 3 with the rolling seal in a neutral position.

FIG. 4 illustrates an enlarged view of a section of the completion tool 100 that includes the fluid chamber 325 and the rolling seal 105. As mentioned above, the rolling seal 105 has an open end 215 and a closed end 210. A first edge 105*a* of the rolling seal 105, adjacent the open end 215 is attached to an outer diameter of the inner tube mandrel 320 and a second opposing edge 105*b* of the rolling seal is attached to an inner diameter of the outer housing 305. The rolling seal 105 may be attached to the inner tube mandrel 320 and outer housing 305 by any known means that ensures sealing integrity between the smaller fluid chambers 325*a* and 325*b*. The fluid chamber 325 is located up hole of a check valve, which is not shown, that can be used to isolate an area of high pressure as required. The fluid pressure within each of the smaller fluid chambers 325*a* and 325*b* can be increased to cause a pressure imbalance within the fluid chamber 325 that moves the closed end 210 of the rolling seal either up hole or down hole, depending on which side of the rolling seal 105 the fluid pressure is applied. This back and forth movement of the rolling seal 105 within the fluid chamber 325 imparts a fluid pressure on the flow valve actuation device 310 that causes the flow valve (not shown) to move, for example to an open position. In the embodiment shown in FIG. 4, the completion tool 100 is manipulated to cause the fluid pressure 405 in smaller fluid chamber 325*b* to be greater than the fluid pressure in smaller fluid chamber 325*a*, which inverts the closed end in the up hole direction. Thus, the inversion of the rolling seal 105 allows for a transfer of fluid pressure, while maintaining the integrity of the fluid seal.

Figure 5:
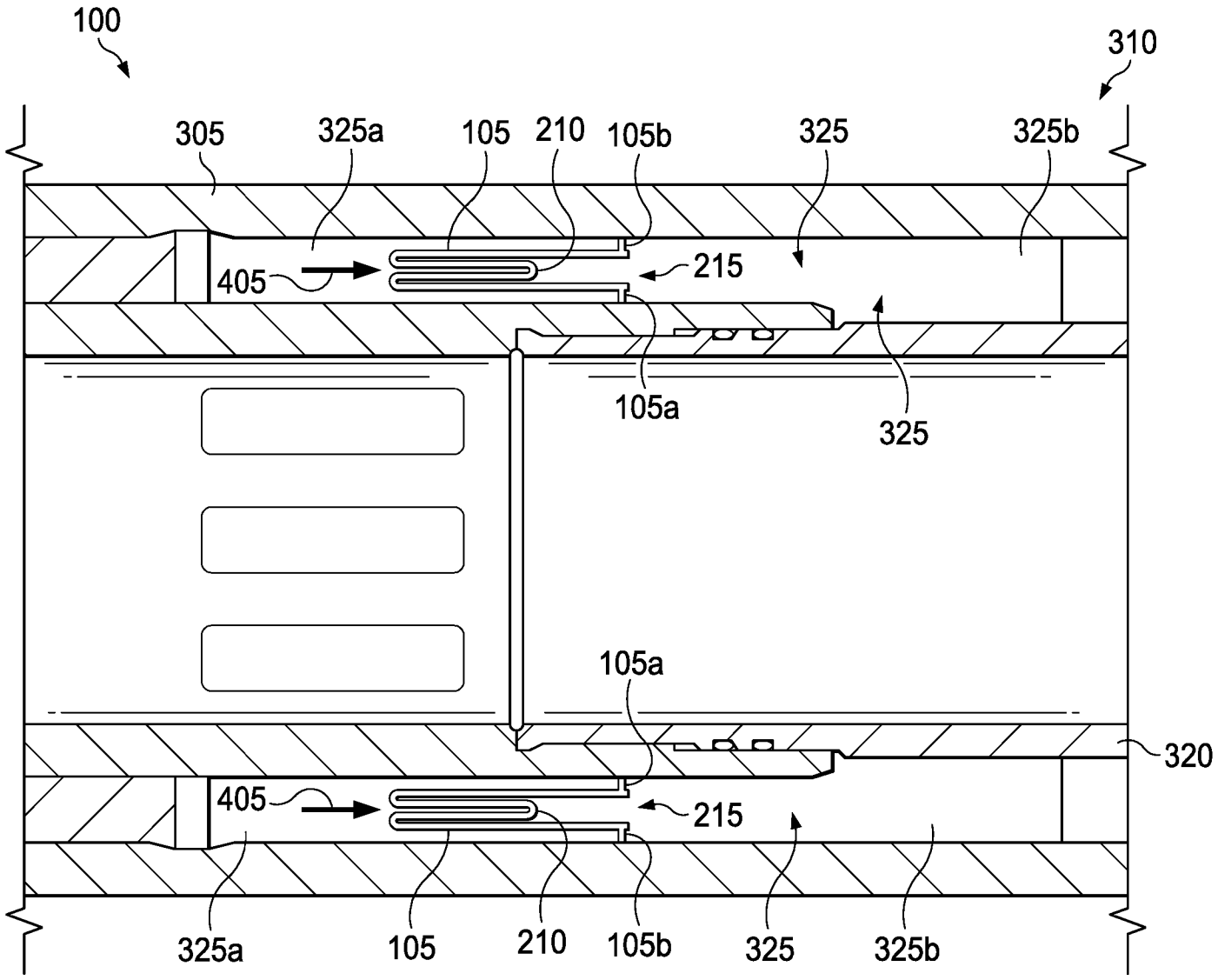
FIG. 5 is an enlarged view of the completion tool of FIG. 3 wherein a fluid pressure has been applied to the rolling seal to cause it to invert in response to an applied fluid pressure.

FIG. 5 illustrates the completion tool 100 of FIG. 4 illustrating the application of the increase fluid pressure 405 in fluid chamber 325*a* that is greater than the fluid pressure in fluid chamber 325*b*. As seen, this increased fluid pressure 505 drives the closed end 210 of the rolling seal 105 in the down hole direction and toward the flow valve actuation assembly 310, thereby increasing the fluid pressure in the smaller fluid chamber 325*b*, which transfers pressure to the flow valve actuation assembly 310.

Figure 6:
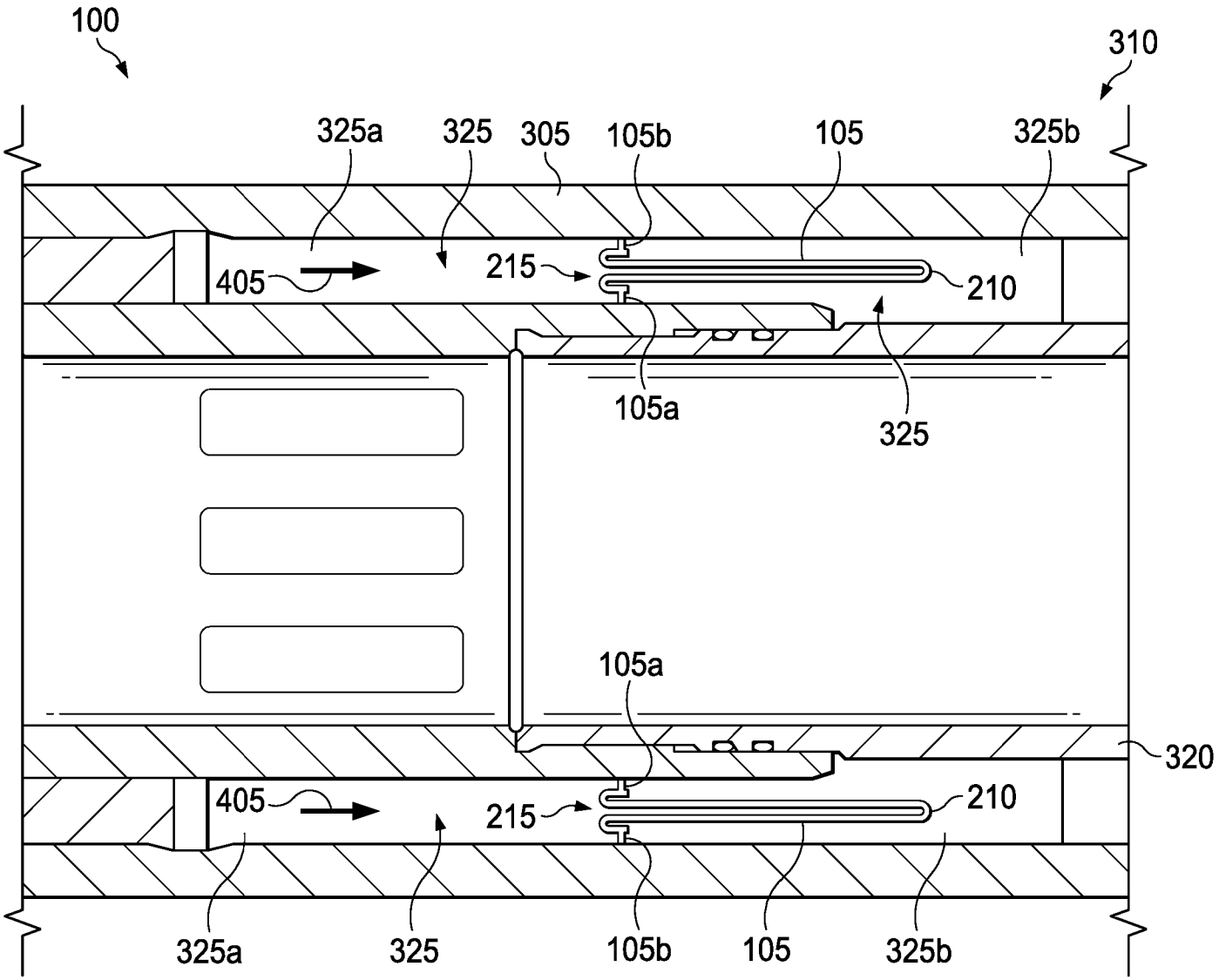
FIG. 6 is an enlarged view of the completion tool of FIG. 3 wherein the fluid pressure has caused the rolling seal to substantially invert.

FIG. 6 illustrates the completion tool 100 of FIG. 5 illustrating the continued application of the increased fluid pressure 405 in fluid chamber 325*a* that is greater than the fluid pressure in fluid chamber 325*b*. As seen, the increased fluid pressure 405 drives the closed end 210 of the rolling seal 105 in the down hole direction and toward the flow valve actuation assembly 310 to an extent that substantially inverts the rolling seal 105, causing it to extend in a direction that is opposite of its original orientation.

The fluid pressure can then be reversed by decreasing the fluid pressure in the smaller fluid chamber 325*b*, resulting in an increase pressure in chamber 325*b*, driving the closed end 210 in the up hole direction, until pressure equilibrium is reached. This pressure cycling can be performed any number of times, as required to actuate the flow valve actuation assembly 310. Because the edges 105*a* and 105*b* of the rolling seal 105 are sealing secured to the inner diameter of the outer housing 305 and the inner diameter of the inner tube mandrel 320, fluid pressure can be used to move the ball valve to the desired position.

In one example of an application of the completion tool 100 described above, a wash pipe on the bottom of the completion tool 100 is extended across the ball valve 315*a*. A known collet shifting tool is attached to the end of the wash pipe, which upon retrieval closes the ball valve 315*a* on contact with a nub and shoulder on a locating mandrel and immediately isolates the formation and allows an inflow test from below or a positive pressure to be conducted up hole the ball valve 315*a*. Once pressure integrity is confirmed, the wash pipe and collect shifter are removed from the well bore 110. The upper completion can be installed while the ball valve 315*a* remains in a closed position in the lower completion, isolating the formation 130 and providing a fully tested down hole barrier. The ball valve 315*a* provides remote opening on demand by applying a number of predetermined hydraulic cycles using the rolling seal 105 to apply fluid pressure to the flow valve actuation assembly 310, as described above. Once a decision is made to open the ball valve 315*a*, the rolling seal 105 is hydraulically cycled by pressure cycles that are applied from the surface to the rolling seal 105. In response to the fluid pressure generated by the rolling seal 105, the flow valve actuation assembly 310 then moves through the predetermined number of cycles to de-support flow valve actuation assembly 310, such as an indexing latch, allowing the ball valve 315*a* to open. The ball valve 315*a* opens when applied pressure is removed, thereby avoiding surging the formation 130. The opening of the ball valve 315*a* can be facilitated by a power spring and boost piston associated with the ball valve 315*a* that provides the necessary force to fully open the ball valve 315*a*. Once the ball valve 315*a* is opened, the well can be brought safely into operation.

One embodiment of a method of operating a rolling seal in a fluid chamber defined by an outer housing and an inner tube mandrel of a completion string, comprises: inverting the rolling seal inwardly and outwardly within the fluid chamber to transfer a fluid pressure between the first and second smaller fluid chambers; and actuating a flow valve by the inverting to move the flow valve to either one or both of an open position and closed position. In one aspect of this embodiment, inverting includes applying a first fluid pressure force to the first smaller fluid chamber to cause the rolling seal to invert at least a portion of a length of the rolling seal toward the second smaller fluid chamber, thereby transferring fluid pressure from the first smaller fluid chamber to the second smaller fluid chamber. In yet another aspect of this embodiment, inverting includes applying a second fluid pressure to the second smaller fluid chamber to cause the rolling seal to invert at least a portion of a the length of the rolling seal toward the first smaller fluid chamber, thereby transferring fluid pressure from the second smaller fluid chamber to the first smaller fluid chamber.

In another embodiment of the method, the flow valve is a ball valve and the inverting causes the ball valve to move from a closed position to an open position.

In yet another embodiment, inverting includes inverting a predetermined number of times that transfers fluid pressure to an actuation device positioned between the rolling seal and the flow valve and configured to be responsive to the fluid pressure transfer between the first and second smaller chambers of the rolling seal to move the flow valve to either one or both of the open position and closed position.

The invention having been generally described, the following embodiments are given by way of illustration and are not intended to limit the specification of the claims in any manner.

Embodiments herein comprise:

A completion tool, comprising an outer housing, an inner tube mandrel located within the outer housing, where the outer housing and the inner tube mandrel define a fluid chamber therebetween, and a rolling seal of a flexible material and being located within the fluid chamber. The rolling seal has an open end and an opposing closed end, wherein the open end has a first edge that is attached to an outer diameter of the inner tube mandrel and a second opposing edge attached to an inner diameter of the outer housing to divide the fluid chamber into first and second smaller fluid chambers and fluidly seal the first smaller fluid chamber from the second smaller fluid chamber. The rolling seal is configured to respond to a fluid pressure within the fluid chamber that causes the closed end to invert at least a portion of a length of the rolling seal, thereby transferring fluid pressure between the first and second smaller fluid chambers.

Another embodiment is directed to q well completion system, comprising: a completion string; an outer housing connected to the completion string; an inner tube mandrel located within the outer housing, the outer housing and inner tube mandrel defining a fluid chamber therebetween; a rolling seal of a flexible material and being located within the fluid chamber, the rolling seal having an open end and an opposing closed end, wherein the open end has a first edge that is fixed to an outer diameter of the inner tube mandrel and a second opposing edge fixed to an inner diameter of the outer housing to divide the fluid chamber into first and second smaller fluid chambers and fluidly seal the first smaller fluid chamber from the second smaller fluid chamber, the rolling seal configured to respond to a fluid pressure within the fluid chamber that causes the closed end of the rolling seal to invert into at least a portion of a length of the rolling seal, thereby transferring fluid pressure between the first and second fluid chambers; and a flow valve located within a central flow passage of the inner tube mandrel located between the rolling seal and a terminating end of the completion string and operable to either one or both of an open position and closed position.

Another embodiment is directed to a method of operating a rolling seal in a fluid chamber defined by an outer housing and an inner tube mandrel of a completion string, the rolling seal dividing the fluid chambers into first and second smaller fluid chambers, comprising: inverting the rolling seal inwardly and outwardly within the fluid chamber to transfer a fluid pressure between the first and second smaller fluid chambers; and actuating a flow valve by the inverting to move the flow valve to either one or both of an open position and closed position.

Each of the foregoing embodiments may comprise one or more of the following additional elements singly or in combination, and neither the example embodiments or the following listed elements limit the disclosure, but are provided as examples of the various embodiments covered by the disclosure:

Element 1: wherein the rolling seal is configured to substantially invert along its entire length in response to a fluid pressure.

Element 2: wherein the rolling seal is cylindrically-shaped.

Element 3: wherein the rolling seal has a U-shaped cross section having an outer wall and an inner wall defining an interior volume into which a pressurized fluid may flow.

Element 4: further comprising a flow valve located between the rolling seal and a downhole end of the completion string, the flow valve positioned to operate within a central flow passage of the inner tube mandrel and being movable to either one or both of an open position and closed position.

Element 5: wherein the second driver mechanism comprises: a second biasing member, and a second fluid actuated cylinder having an end coupled to a first side of the second base frame structure and a second driver arm extendable from the second fluid actuated cylinder and across a portion of the width of the second base frame structure from the first position, to the second position, and to the neutral position.

Element 6: further comprising an actuation device positioned between the rolling seal and the flow valve and configured to be responsive to the fluid pressure transfer between the first and second smaller chambers of the rolling seal to move the flow valve to either one or both of the open position and closed position.

Element 7: wherein the flow valve is a ball valve.

Element 8: wherein the rolling seal is configured to substantially invert in response to a fluid pressure.

Element 9: wherein the rolling seal is comprised of a reinforced material.

Element 10: further comprising at least one sand screen located between the rolling seal and the flow valve.

Element 11: wherein inverting includes applying a first fluid pressure force to the first smaller fluid chamber to cause the rolling seal to invert at least a portion of a length of the rolling seal toward the second smaller fluid chamber, thereby transferring fluid pressure from the first smaller fluid chamber to the second smaller fluid chamber.

Element 12: wherein inverting includes applying a second fluid pressure to the second smaller fluid chamber to cause the rolling seal to invert at least a portion of a the length of the rolling seal toward the first smaller fluid chamber, thereby transferring fluid pressure from the second smaller fluid chamber to the first smaller fluid chamber.

Element 13: wherein the flow valve is a ball valve and the inverting causes the ball valve to move from a closed position to an open position.

Element 14: wherein inverting includes inverting a predetermined number of times that transfers fluid pressure to an actuation device positioned between the rolling seal and the flow valve and configured to be responsive to the fluid pressure transfer between the first and second smaller chambers of the rolling seal to move the flow valve to either one or both of the open position and closed position.

What is claimed is:

1. A completion tool, comprising:

an outer housing;

an inner tube mandrel located within the outer housing, the outer housing and the inner tube mandrel defining a fluid chamber therebetween; and a rolling seal of a flexible material and being located within the fluid chamber, the rolling seal having an open end and an opposing closed end, wherein the open end has a first edge that is attached to an outer diameter of the inner tube mandrel and a second opposing edge attached to an inner diameter of the outer housing to divide the fluid chamber into first and second smaller fluid chambers and fluidly seal the first smaller fluid chamber from the second smaller fluid chamber, the rolling seal configured to respond to a fluid pressure within the fluid chamber that causes the closed end to invert at least a portion of a length of the rolling seal, thereby transferring fluid pressure between the first and second smaller fluid chambers.

2. The completion tubing string of claim 1, wherein the rolling seal is configured to substantially invert along its entire length in response to the fluid pressure.

3. The completion tubing string of claim 1, wherein the rolling seal is cylindrically-shaped.

4. The completion tubing string of claim 3, wherein the rolling seal has a U-shaped cross section having an outer wall and an inner wall defining an interior volume into which a pressurized fluid may flow.

5. The completion tubing string of claim 1, further comprising a flow valve located between the rolling seal and a downhole end of a completion string, the flow valve positioned to operate within a central flow passage of the inner tube mandrel and being movable to either one or both of an open position and closed position.

6. The completion tubing string of claim 5, further comprising an actuation device positioned between the rolling seal and the flow valve and configured to be responsive to the fluid pressure transfer between the first and second smaller chambers of the rolling seal to move the flow valve to either one or both of the open position and closed position.

7. The completion tubing string of claim 1, wherein the rolling seal configured to invert in either direction as the fluid pressure is applied to one side of the rolling seal and then to the other.

8. A well completion system, comprising:

a completion string;

an outer housing connected to the completion string;

an inner tube mandrel located within the outer housing, the outer housing and inner tube mandrel defining a fluid chamber therebetween;

a rolling seal of a flexible material and being located within the fluid chamber, the rolling seal having an open end and an opposing closed end, wherein the open end has a first edge that is fixed to an outer diameter of the inner tube mandrel and a second opposing edge fixed to an inner diameter of the outer housing to divide the fluid chamber into first and second smaller fluid chambers and fluidly seal the first smaller fluid chamber from the second smaller fluid chamber, the rolling seal configured to respond to a fluid pressure within the fluid chamber that causes the closed end of the rolling seal to invert into at least a portion of a length of the rolling seal, thereby transferring fluid pressure between the first and second fluid chambers; and a flow valve located within a central flow passage of the inner tube mandrel located between the rolling seal and a terminating end of the completion string and operable to either one or both of an open position and closed position.

9. The well completion system of claim 8, wherein the rolling seal is configured to substantially invert in response to the fluid pressure.

10. The well completion system of claim 8, wherein the rolling seal is cylindrically-shaped.

11. The well completion system of claim 10, wherein the rolling seal has a U-shaped cross section having an outer wall and an inner wall defining an interior volume into which a pressurized fluid may flow.

12. The well completion system of claim 8, wherein the flow valve is a ball valve system.

13. The well completion system of claim 12, wherein the rolling seal is comprised of a reinforced material.

14. The well completion system of claim 8, further comprising an actuation device positioned between the rolling seal and the flow valve and configured to be responsive to the fluid pressure transfer between the first and second smaller chambers of the rolling seal to move the flow valve from either one or both of the open position and closed position.

15. The well completion system of claim 8, further comprising at least one sand screen located between the rolling seal and the flow valve.

16. A method of operating a rolling seal in a fluid chamber defined by an outer housing and an inner tube mandrel of a completion string, the rolling seal dividing the fluid chamber into first and second smaller fluid chambers, comprising:

inverting the rolling seal inwardly and outwardly within the fluid chamber to transfer a fluid pressure between the first and second smaller fluid chambers; and actuating a flow valve by the inverting to move the flow valve to either one or both of an open position and closed position.

17. The method of claim 16, wherein inverting includes applying a first fluid pressure force to the first smaller fluid chamber to cause the rolling seal to invert at least a portion of a length of the rolling seal toward the second smaller fluid chamber, thereby transferring fluid pressure from the first smaller fluid chamber to the second smaller fluid chamber.

18. The method of claim 17, wherein inverting includes applying a second fluid pressure force to the second smaller fluid chamber to cause the rolling seal to invert toward the first smaller fluid chamber, thereby transferring fluid pressure from the second smaller fluid chamber to the first smaller fluid chamber.

19. The method of claim 16, wherein the flow valve is a ball valve and the inverting causes the ball valve to move from a closed position to an open position.

20. The method of claim 16, wherein inverting includes inverting a predetermined number of times that transfers fluid pressure to an actuation device positioned between the rolling seal and the flow valve and configured to be responsive to the fluid pressure transfer between the first and second smaller chambers of the rolling seal to move the flow valve to either one or both of the open position and closed position.

* * * * *